United States Patent [19]

Theurer

[11] Patent Number: 4,881,467

[45] Date of Patent: Nov. 21, 1989

[54] CONTINUOUSLY ADVANCING TRACK MAINTENANCE OR REHABILITATION MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 196,285

[22] Filed: May 20, 1988

[30] Foreign Application Priority Data

Sep. 4, 1987 [AT] Austria ..... 2237/87

[51] Int. Cl.[4] ..... E01B 27/17

[52] U.S. Cl. ..... 104/7.2; 104/12

[58] Field of Search ..... 104/2, 7.1, 7.2, 7.3, 104/279, 12; 37/104, 105; 105/4.3

[56] References Cited

U.S. PATENT DOCUMENTS

| | | | |
|---|---|---|---|
| 1,552,611 | 8/1925 | Jackson | 104/12 |
| 3,910,195 | 10/1975 | Theurer . | |
| 4,046,078 | 8/1977 | Theurer | 104/7.2 |
| 4,165,693 | 8/1979 | Theurer | 104/12 X |
| 4,257,331 | 3/1981 | Theurer et al. | 104/7.2 X |
| 4,627,358 | 12/1986 | Theurer . | |
| 4,643,101 | 2/1987 | Theurer . | |
| 4,703,568 | 11/1987 | Theurer et al. | 104/12 X |

FOREIGN PATENT DOCUMENTS 1191739 8/1985 Canada .

OTHER PUBLICATIONS

Eisenbahntechnik, No. 4, 1986, pp. 20/21, article: "The modern systems for track maintenance and track renewal".

*Primary Examiner*—Johnny D. Cherry
*Assistant Examiner*—Frank Williams, Jr.
*Attorney, Agent, or Firm*—Kurt Kelman

[57] ABSTRACT

A continuous action track maintenance or rehabilitation machine comprises a first machine frame, a carrier frame arranged between the undercarriages supporting the first machine frame on the track, ballast tamping and track lifting and lining units vertically adjustably mounted on the carrier frame, and a drive linking the carrier frame to the first machine frame for longitudinally displacing the carrier frame with respect thereto. A second machine frame is linked to the rear end of the first machine frame, and a plow arrangement is vertically adjustably mounted on the second machine frame between the undercarriages thereof, the plow arrangement comprising a drive connecting the plow arrangement to the second machine frame for vertically adjusting the plow arrangement with respect thereto, a center plow for plowing ballast between the rails of the track, shoulder plows for plowing ballast laterally adjacent each one of the rails, and a drive for operating each one of the plows.

10 Claims, 1 Drawing Sheet

CONTINUOUSLY ADVANCING TRACK MAINTENANCE OR REHABILITATION MACHINE

BACKGROUND OF THE INVENTION (1) Field of the Invention

The present invention relates to a machine continuously advancing in an operating direction for maintaining or rehabilitating a railroad track consisting of two rails fastened to successive ties resting on ballast. The machine comprises a machine frame supported on two undercarriages for continuous movement in the operating direction, the undercarriages being spaced apart in this direction and the machine frame having a front end and a rear end with respect to this direction, a carrier frame arranged between the undercarriages, a track lifting and lining unit vertically adjustably mounted on the carrier frame, a ballast tamping unit vertically adjustably mounted on the carrier frame, the ballast tamping unit comprising pairs of reciprocatory and vibratory tamping tools immersible in the ballast upon vertical adjustment of the ballast tamping unit for tamping ballast under respective ones of said ties, and a drive linking the carrier frame to the first machine frame for longitudinally displacing the carrier frame with respect thereto.

(2) Description of the Prior Art

To obtain a degree of track position accuracy and an extended duration of the accurately positioned track required for the ever increasing train speeds encountered in railroads, Canadian patent No. 1,191,739 proposes the use of a group of successively arranged track working machines for bringing a railroad track into a desired position and to fix it in that position. Such a succession of coordinated track maintenance or rehabilitation machines, of which the most important one always is a track leveling, lining and tamping machine, has become known as a "mechanized track work train" (MDZ) whose individual machines are coordinated with respect to their work but which advance and operate independently of each other. Each individual machine has its own operator's cab and its own drive, which requires an operating crew for each machine. The mechanized track work train disclosed in the Canadian patent comprises a continuously advancing ballast cleaning machine followed, in the operating direction, by an intermittently advancing track leveling, lining and tamping machine and, finally, a continuously operating track stabilization machine. In this manner, the cleaned ballast discharged from the ballast cleaning machine into the track bed is tamped under the ties as the track is leveled and/or lined to obtain a desired track position, and the track is then lowered into a permanent position by compacting the ballast under controlled conditions by the vibratory rail-engaging tools of the track stabilization machine. This type of mechanized track work train, whose individual machines may be changed according to the desired results, has been used very successfully in track maintenance and rehabilitation work but it requires relatively expensive individual machines and large work crews, considering the requirement for individual control personnel for each machine.

In an article entitled "The modern systems for track maintenance and track renewal" in "Eisenbautechnik", No. 4, 1986, pages 20/21, it has been disclosed that the efficiency of a mechanized track work train (H-MDZ) may be increased by the use of a continuous action track leveling, lining and tamping machine with a longitudinally displaceable carrier frame for the ballast tamping and track lining and leveling units, which may or may not be supported by an undercarriage on the track rails, such as disclosed, for example, in U.S. Pat. No. 4,627,358, dated Dec. 9, 1986. This continuously advancing machine is followed, in the operating direction, by a continuously operating ballast planing and compacting machine with which the ballast is leveled and/or moved into zones where the rail-engaging vibratory tools of the following dynamic track stabilization machine operate. This high-efficiency mechanized track work train also has been used with great success but also requires relatively expensive machinery and a large work crew.

A continuously advancing track leveling, lining and tamping machine for tamping ballast under the successive ties of a railroad track is also known from U.S. Pat. No. 4,643,101, dated Feb. 17, 1987. The machine comprises a machine frame having a front end supported on an undercarriage, and a hydraulic cylinder drive longitudinally displaceably links a carrier frame to the machine frame. A track lifting and lining unit is vertically adjustably mounted on the carrier frame, and a ballast tamping unit is vertically adjustably mounted on the carrier frame, the ballast tamping unit comprising pairs of reciprocatory and vibratory tamping tools immersible in the ballast upon vertical adjustment of the ballast tamping unit for tamping ballast under respective ones of said ties. The carrier frame cyclically moves from tie to tie while the machine frame advances non-stop. An operator's cab is mounted at a rear end of the machine frame within sight of the ballast tamping unit and the machine frame has a projecting rear end portion extending to the center of a succeeding auxiliary frame on which the projecting rear end machine frame portion is supported. The auxiliary frame is supported on the track rails by front and rear undercarriages so that the longitudinally displaceable carrier frame is arranged between two undercarriages, i.e. the front undercarriages of the machine frame and the auxiliary frame. Two track stabilization units with vertically adjustable vibratory track stabilizing devices are mounted on the auxiliary frame between the front and rear undercarriages thereof. The structure and support of the machine frame is such that a portion of the heavy weight of the ballast tamping means is transferred to the auxiliary frame, which enhances the effectiveness of the track stabilization units in lowering the track to its desired stabilized end position. This is a specialized machine integrating ballast tamping and stabilization. It frequently requires the subsequent use of a ballast plow for planing and shaping the ballast bed.

U.S. Pat. No. 3,910,195, dated Oct. 7, 1975, discloses a mobile, intermittently advancing track tamper designed to tamp two successive ties during each tamping cycle. The tamping tool assembly of this machine has pairs of opposed reciprocatory and vibratory tamping tools arranged for immersion in the cribs for tamping ballast under the ties and additional vibratory tamping tools arranged for immersion in the ballast adjacent the ends of the ties for reciprocation in the direction of tie elongation whereby a high ballast compaction is obtained at the intersections of the ties and rails where the track rails are supported. Small ballast plows are arranged rearwardly of the tamping tool assemblies at each track shoulder to enable ballast to be moved from the shoulders to the region immediately adjacent the tie ends. This makes it possible for immediately following surface tampers to consolidate or compact the ballast at the tie ends. Such shoulder plows and ballast compactors are not needed in the absence of tie end tamping tools.

SUMMARY OF THE INVENTION

It is the primary object of this invention to make continuously advancing track maintenance and rehabilitation machines more economical to operate and more adaptable to different operating requirements and conditions.

In a machine of the type described under the heading "Field of the Invention", the above and other objects are accomplished with a second machine frame supported on two undercarriages, the undercarriages being spaced apart in the operating direction and the second machine frame having a front end and a rear end with respect to this direction. A coupling links the second machine frame front end to the rear end of the first machine frame, and a plow arrangement is vertically adjustably mounted on the second machine frame between the undercarriages thereof. The plow arrangement comprises drive means connecting the plow arrangement to the second machine frame for vertically adjusting the plow arrangement with respect thereto, a center plow for plowing ballast between the rails of the track, shoulder plows for plowing ballast laterally adjacent each one of the rails, and drive means for operating each one of the plows.

With such a continuous action track maintenance or rehabilitation machine, it has become possible for the first time to plane and shape the ballast bed in the same operating cycle as the tie tamping and immediately following the same so that a single machine will in a most economical and effective manner not only level and line the track and fix the track in its leveled and lined position by tamping ballast under the ties of the leveled and lined track but also will uniformly and evenly spread and fill the ballast in the cribs between the tamped ties. The plow arrangement mounted on the machine behind the ballast tamping unit thus has the particular advantage of enhancing the permanency of the corrected track position because the plow arrangement on the machine will assure that all the cribs will be uniformly filled with ballast even though different amounts of ballast may have been removed from respective cribs by the reciprocatory tamping tools to be tamped under adjacent ties, depending on different extents of level correction required for such ties. No separate ballast plow machine is required and, therefore, it is possible immediately to stabilize the track by settling the track in a permanent position wherein it is embedded in the ballast bed at a level otherwise achieved by the initial train traffic on the freshly tamped corrected track. Since the plow arrangement is mounted on its own machine frame linked to the rear end of the tamper machine frame and supported on the railroad track rails by undercarriages, the plows will be automatically centered even in sharp curves. Furthermore, since the two machine frames are coupled for common continuous movement in the operating direction, uniform and highly efficient ballast tamping and shaping is obtained while the carrier frame for the ballast tamping unit is cyclically displaced.

BRIEF DESCRIPTION OF THE DRAWING

The above and other objects, features and advantages of the invention will become more apparent from the following detailed description of certain now preferred embodiments thereof, taken in conjunction with the accompanying somewhat schematic drawing wherein.

DESCRIPTION OF THE PREFERRED EMBODIMENTS

Figures 1, 2, 3:
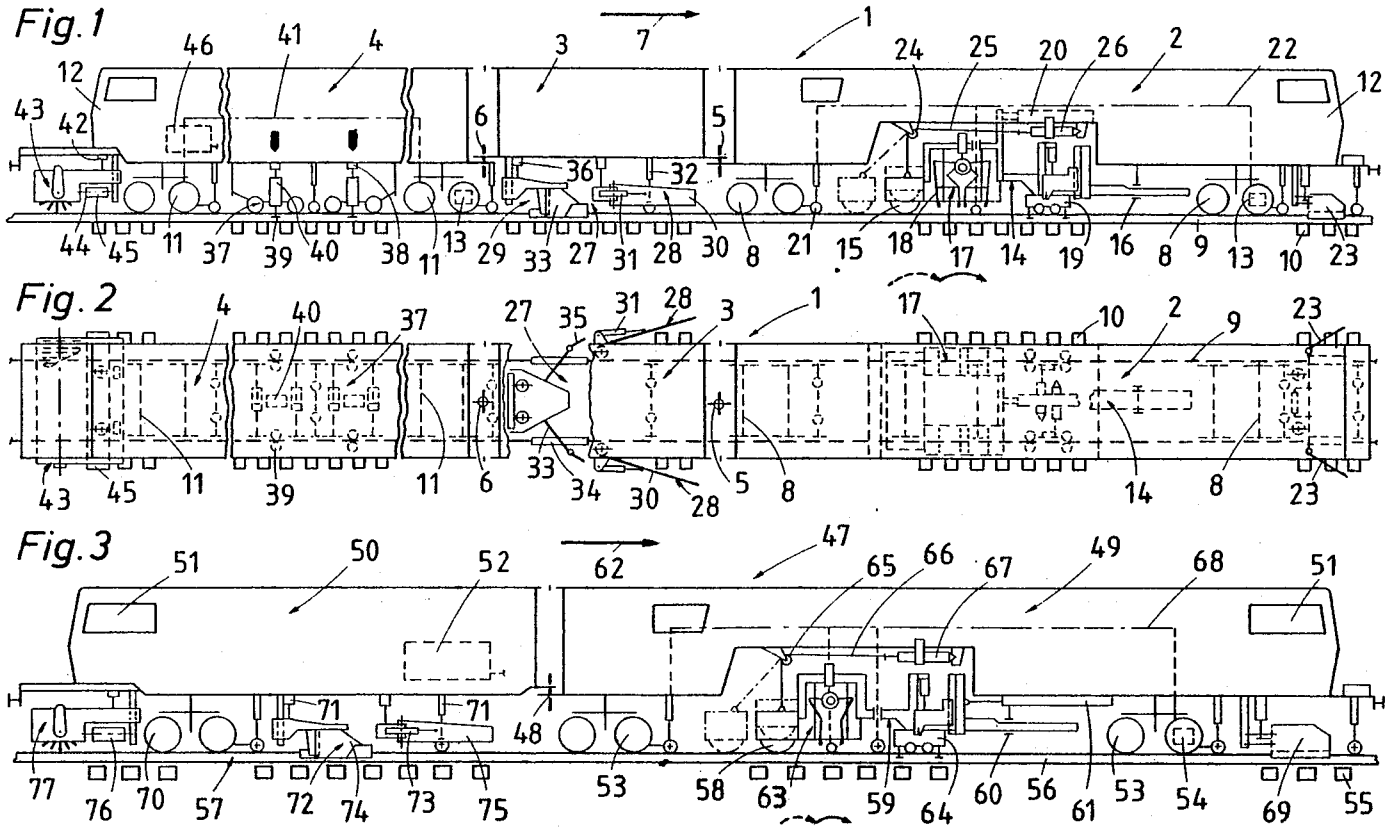
FIG. 1 is a side elevational view of one embodiment of a continuously advancing track maintenance or rehabilitation machine incorporating three linked machine frames respectively mounting a ballast tamping unit, a ballast plow arrangement and a track stabilization unit.
FIG. 2 is a top view of the machine of FIG. 1.
FIG. 3 is a side elevational view of another continuously advancing track maintenance or rehabilitation machine incorporating two linked machine frames respectively mounting a ballast tamping unit and a ballast plow arrangement.

FIGS. 1 and 2 show machine 1 continuously advancing in an operating direction indicated by arrow 7 for maintaining or rehabilitating a railroad track consisting of two rails 9 fastened to successive ties 10 resting on ballast. The machine comprises first machine frame 2 supported on undercarriages 8 for continuous movement in the operating direction, the undercarriages being spaced apart in this direction and the machine frame having a front end and a rear end with respect to this direction. Carrier frame 14 is arranged between the undercarriages. Track lifting and lining unit 19 as well as ballast tamping unit 17 are vertically adjustably mounted on carrier frame 14, the ballast tamping unit comprising pairs of reciprocatory and vibratory tamping tools 18 immersible in the ballast upon vertical adjustment of the ballast tamping unit for tamping ballast under respective ties 10. Drive 20 links carrier frame 14 to first machine frame 2 for longitudinally displacing the carrier frame with respect thereto.

In the illustrated embodiment, the carrier frame has a rear end supported on rails 9 by single-axled undercarriage 15 and a central boom projecting forwardly from a rear end frame portion and longitudinally displaceably carried in bearing 16 affixed to machine frame 2. The ballast tamping unit has two adjacent pairs of tamping tools 18, the twin pairs of tamping tools being arranged for tamping two adjacent ties 10 in one tamping cycle. The ballast tamping and track leveling and lining units 17, 19 are vertically adjustably mounted on the rear end frame portion of carrier frame 14, ballast tamping unit 17 immediately preceding undercarriage 15 and track leveling and lining unit 19 preceding the ballast tamping unit in the operating direction. A further drive links carrier frame 14 to the first machine frame for raising the carrier frame off the track into a rest position, the drive comprising elongated tension element 25, such as a rope or cable, having one end connected to the carrier frame rear end, pulley 24 mounted on the first machine frame, rope or cable 25 being trained over the pulley, and motor 26 mounted on the first machine frame, an end of the rope or cable opposite to the one end being connected to the motor. The illustrated motor is a hydraulic cylinder. This arrangement has the advantage of permitting the carrier frame to be moved between an operating and a rest position, in which support undercarriage 15 is lifted off the track when machine 1 is moved from one operating site to another while flexible elongated tension element 25 constitutes no hindrance to the cyclic displacement of carrier frame 14 during operation of the machine.

As shown, conventional leveling and lining reference system 22 is carried by first machine frame 2 and is supported on rails 9 by rail sensing rollers 21.

The first machine frame front end projects beyond front undercarriage 8 of first machine frame 2, and vertically and laterally adjustable ballast plow 23 is mounted on the projecting front end at each rail 9. These front plows preceding the ballast tamping units associated with each rail enable the cribs to be uniformly filled with ballast in the regions of the tie ends, where the track rails are supported on the ties, as the machine continuously advances in the operating direction indicated by arrow 7. This provides an advantageous ballast distribution for the immediately subsequent tamping of the ballast under the ties in these regions.

According to the present invention, a second machine frame 3 supported on undercarriages 8 and 11 has a front end linked to the rear end of first machine frame 2 by coupling 5, the undercarriages being spaced in the operating direction. Plow arrangement 27 is vertically adjustably mounted on the second machine frame between the undercarriages thereof. The plow arrangement comprises drive means 32, 36, i.e. hydraulic cylinder drives, connecting the plow arrangement to second machine frame 3 for vertically adjusting the plow arrangement with respect thereto, center plow 29 for plowing ballast between rails 9 of the track, shoulder plows 28 preceding the center plow in the operating direction for plowing ballast laterally inwardly adjacent each rail 9, and drive means 31 for operating each plow. The shoulder plows are two transversely spaced plow blades 30 pivotally connected to the second machine frame at one of their ends for pivoting about a vertical axis, and hydraulic cylinder drives 31 connect the plow blades to the second machine frame for pivoting the plow blades into adjusted operating positions. Hydraulic cylinder drives 32 connect the plow blades to the second machine frame for vertically adjusting the plow blades. The succeeding center plow is comprised of a pair of plow blades 33 arranged in V-formation and short plow blades 35 connected to the outer ends of plow blades 33 and pivotally connected thereto for pivoting about vertical axes. U-shaped channel members embracing each rail 9 are attached to the undersides of plow blades 33 so that the plowed ballast will be kept away from the rails as machine 1 continuously advances and plows the ballast. Center plow 29 is connected to the second machine frame by hydraulic cylinder drives 36 for vertically adjusting the center plow.

In the embodiment of FIGS. 1 and 2, third machine frame 4 follows second machine frame 2 in the operating direction and is supported on undercarriages 11, the undercarriages being spaced in this direction and the third machine frame having a front end and a rear end with respect to this direction. Coupling 6 links the third machine frame front end to the rear end of second machine frame. Two track stabilization units 37 are vertically adjustably mounted on the third machine frame between the undercarriages thereof. Each track stabilization unit comprises drive means 38 connecting the track stabilization unit to the third machine frame for vertically adjusting the track stabilization unit with respect thereto, track stabilizing tools 39 engaging the rails, and vibratory drive means 40 connected to the track stabilizing tools for vibrating the same in a generally horizontal direction. As is conventional in dynamic track stabilization apparatus, the track stabilization tools are laterally pivotal rollers or clamps arranged to be pivoted into tight clamping engagement with rails 9 whereby the track will be firmly held by the tools while their transverse vibrations and downward pressure are transferred to the rails to force the vibrating and downwardly pressed track to settle the ballast and become embedded therein. Vertical adjustment drives 38 are controlled by leveling reference system 41 supported on the track rails by rail sensing rollers.

Such a tri-partite machine for tamping, plowing and stabilizing the ballast bed for the first time permits a continuous complete track surfacing in a single operating cycle. Great economies are obtained because a single machine is used and the operating crew may be considerably reduced since the operating steps may be more easily coordinated and controlled. Since ballast plowing and stabilization can be effected in a continuous operation, its combination with a continuously advancing high-efficiency tamper provides particularly rapid and efficient track work while, at the same time, improving the uniformity and accuracy of the track position. All the operating tools being mounted on a single machine, their coordination is greatly facilitated to obtain accurate and optimal results with the greatest possible efficiency.

In the illustrated embodiment, the front end of second machine frame 3 is is supported on rear undercarriage 8 supporting first machine frame 2 at the rear end thereof and the rear end of second machine frame 3 is supported on front undercarriage 11 supporting third machine frame 4 at the front end thereof. Rear undercarriage 8 of the first machine frame and front undercarriage 11 of the third machine frame at the front end thereof constitute the two undercarriages supporting the second machine frame. This arrangement saves additional undercarriages and also reduces the overall length of the machine. Couplings 5 and 6 link the machine frames so that they may freely pivot with respect to each other about vertical axes. This will automatically center the plows and track stabilization units when machine 1 works in sharp curves.

As shown in FIGS. 1 and 2, the third machine frame rear end projects beyond rear undercarriage 11 of third machine frame 4, and ballast broom arrangement 43 is mounted on the projecting rear end. Hydraulic cylinder drive 42 connects the ballast broom arrangement to the projecting third machine frame rear end for vertical adjustment thereof with respect thereto, and transversely extending conveyor band 45, driven by drive 44, is arranged on the projecting rear end for receiving ballast from broom arrangement 43 and conveying the same laterally adjacent the rails for depositing the swept ballast at the track shoulders. This enables the track to be swept clean at the completion of the work and to remove ballast deposited on the ties by the horizontal vibrations of the track stabilization tools.

As shown, a respective operator's cab 12 is mounted at the front end of first machine frame 2 and at the rear end of third machine frame 4, and a respective drive 13 is connected to two of the four undercarriages of machine 1. The undercarriages are two-axled swivel trucks. Undercarriages 8 supporting first machine frame 2 and undercarriages 11 supporting third machine frame 4 are sufficiently spaced in the operating direction for respectively permitting an effective leveling and lining of the track under the control of reference system 22 and an effective track stabilization under the control of reference system 41 between the spaced undercarriages. Such a machine will operate effectively even in sharp curves despite its relatively considerable length, and the two operator's cabs at the ends of the machine will enable the machine to be moved in either direction for transport to another operating site. Suitable spacing of undercarriages 8, 8 and 11, 11 will assure the track position correction and stabilization to be effected properly and without undue bending stress on the track rails, the positioning of the plow arrangement intermediate the first and third machine frames separating the track leveling and lining sufficiently from the track stabilization to prevent any undesirable interference of these two operations with each other.

FIG. 3 illustrates a simpler embodiment of this invention. Illustrated machine 47 is comprised of first machine frame 49 supported on undercarriages 53 on railroad track 57 consisting of rails 56 fastened to ties 55 for continuous movement in an operating direction indicated by arrow 62 and second machine frame 50. The front end of second machine frame 50 is supported on a rear one of undercarriages 53 supporting first machine frame 49 at the rear end thereof, rear undercarriage 53 of the first machine frame and a rear undercarriage 70 of the second machine frame at the rear end thereof constituting the two undercarriages supporting second machine frame 50, i.e. the second machine frame is cantilevered on the rear end of the first machine frame. Coupling 48 links the front end of the second machine frame and the rear end of the first machine frame for pivoting about a vertical axis. The second machine frame rear end projects beyond rear undercarriage 70 of second machine frame 50, and ballast broom arrangement 77 is mounted on this projecting rear end. Driven, transversely extending conveyor band 76 is arranged on the projecting rear end for receiving ballast from the broom arrangement and conveying the same laterally adjacent the rails. In this way, any excess ballast is swept off the ties onto the conveyor band which transports this ballast to the track shoulders. Because the broom arrangement is located behind rear undercarriage 70 of second machine frame 50, the distance between this undercarriage and front coupling 48 is relatively short. A respective operator's cab 51 is mounted at the front end of first machine frame 49 and at the rear end of second machine frame 50, and drive 55 is connected to at least one of the three undercarriages of the machine. Central power plant 52 is mounted on second machine frame 50.

Similar to the embodiment of FIGS. 1 and 2, carrier frame 59 is arranged between undercarriages 53 of first machine frame 49. Track lifting and lining unit 64 as well as ballast tamping unit 63 are vertically adjustably mounted on carrier frame 49, the ballast tamping unit comprising pairs of reciprocatory and vibratory tamping tools immersible in the ballast upon vertical adjustment of the ballast tamping unit for tamping ballast under respective ties 55. Drive 67 links carrier frame 59 to first machine frame 49 for longitudinally displacing the carrier frame with respect thereto.

The illustrated embodiment carrier frame has a rear end supported on rails 56 by single-axled undercarriage 58 and a central boom projecting forwardly from a rear end frame portion and longitudinally displaceably carried in bearing 60 affixed to machine frame 49. The ballast tamping and track leveling and lining units 63, 64 are vertically adjustably mounted on the rear end frame portion of carrier frame 59, ballast tamping unit 63 immediately preceding undercarriage 58 and track leveling and lining unit 64 preceding the ballast tamping unit in the operating direction. A further drive links carrier frame 59 to the first machine frame for raising the carrier frame off the track into a rest position, the drive comprising elongated tension element 66, such as a rope or cable, having one end connected to the carrier frame rear end, pulley 65 mounted on the first machine frame, rope or cable 66 being trained over the pulley, and motor 67 mounted on the first machine frame, an end of the rope or cable opposite to the one end being connected to the motor. The illustrated motor is a hydraulic cylinder. As shown, conventional leveling and lining reference system 68 is carried by first machine frame 49 and is supported on rails 56 by rail sensing rollers.

The first machine frame front end projects beyond front undercarriage 53 of the first machine frame, and vertically and laterally adjustable ballast plow 69 is mounted on the projecting front end at each rail 56.

Also in a manner similar to that of the first described embodiment, plow arrangement 72 is vertically adjustably mounted on second machine frame 50 between the undercarriages supporting the same. The plow arrangement comprises hydraulic cylinder drives 71 connecting the plow arrangement to second machine frame 50 for vertically adjusting the plow arrangement with respect thereto, center plow 74 for plowing ballast between rails 56 of the track, shoulder plows 75 preceding the center plow in the operating direction for plowing ballast laterally inwardly adjacent each rail 56, and drive means 73 for operating each plow. The distance between rear undercarriage 70 and coupling 48 of second machine frame 50 is relatively short, which assures an automatic centering of the plow arrangement even in sharp curves.

The operation of the machine will now be explained in more detail in connection with the embodiment of FIGS. 1 and 2.

After machine 1 has reached the operating site of a track section whose ballast previously has been cleaned by a ballast cleaning machine, motor 26 is actuated to lower carrier frame 14 from its rest position into the operating position wherein the wheels of support undercarriage 15 engage the track rails. Ballast tamping units 17 and track leveling and lining unit 19 are now in operating condition. At the same time, front plows 23 are lowered into their operating position after their angle of inclination with respect to the track rails has been adjusted in a desired manner. Plow arrangement 27 on second machine frame 3 is similarly lowered and the plow angles are suitably adjusted. Track stabilization units 37, too, are lowered in their operating positions and stabilizing tools 39 are firmly clamped to the track rails so that the track stabilization units hold the track in a vise. Broom arrangement 43 is lowered until the hose-like sweeping elements of the transversely extending rotary broom touch ties 10. After the vibratory drives for vibrating tamping tools 18 and stabilizing tools 37 have been actuated to vibrate the tamping tools and impart a horizontal vibration to the track clamped to the track stabilization units, forward drive 13 is actuated for the continuous advancement of machine 1 in the operating direction indicated by arrow 7.

Upon advancement of the machine, inclined plows 23 at each rail 9 will continuously remove the cleaned ballast deposited by the preceding ballast cleaning machine on the tie ends from the tie surfaces. While immersed tamping tools 18 tamp two adjacent ties during each tamping cycle, carrier frame 14 is held against movement by drive 20, causing a relative longitudinal displacement between the carrier frame and continuously advancing machine frame 2. As soon as the tamping cycle has been completed and carrier frame 14 has reached its rear end position indicated in chain-dotted lines, power is supplied to drive 20 to move the carrier frame rapidly into its front end position where it is ready for the next tamping cycle.

Depending on the ballast bed condition, shoulder plows 30 lowered into engagement with the ballast on the track shoulders will move ballast onto the surfaces of the ties whence the ballast will be further moved by the immediately following plow blades 33 over channel-shaped elements 34 to the middle of the ballast bed between the track rails to fill the cribs and to plane the ballast bed. In this manner, the cribs are uniformly filled with ballast to compensate for uneven ballast density due to differing amounts of ballast previously removed from the cribs by tamping tools 18 to tamp ties requiring different extents of leveling. The larger the leveling errors to be corrected, the higher the ties must be raised, requiring larger amounts of ballast to be tamped thereunder. Plow arrangement 27 assures a uniform ballast bed on which the track is stabilized in its settled end position by track stabilization units 37 on third machine frame 4. Since machine 1 works on the track during its continuous advancement in a single flow, beginning with the track position correction by track leveling and lining unit 19, tie tamping by ballast tamping unit 17, ballast planing by plow arrangement 27 and, finally, controlled track stabilization by units 37, the final track position is particularly accurate and stable for an extended period of time. Since all of the operating units on the single machine may be fully coordinated while the machine advances non-stop, the machine has an exceptionally high efficiency.

The simplified machine of FIG. 3 operates in the identical manner, without track stabilization. To preempt initial settling of the track corrected by machine 47 by subsequent train traffic, it may be desirable to work the corrected track by a subsequent track stabilization machine.

What is claimed is:

1. A machine continuously advancing in an operating direction for maintaining or rehabilitating a railroad track consisting of two rails fastened to successive ties resting on ballast, which comprises:

(a) a first machine frame supported on two undercarriages for continuous movement in the operating direction, the undercarriages being spaced apart in said direction and the machine frame having a front end and a rear end with respect to said direction, (b) a carrier frame arranged between the undercarriages, (c) a track lifting and lining unit vertically adjustably mounted on the carrier frame, (d) a ballast tamping unit vertically adjustably mounted on the carrier frame, the ballast tamping unit comprising (a) pairs of reciprocatory and vibratory tamping tools immersible in the ballast upon vertical adjustment of the ballast tamping unit for tamping ballast under respective ones of said ties, (e) a drive linking the carrier frame to the first machine frame for longitudinally displacing the carrier frame with respect thereto, (f) a second machine frame supported on two undercarriages, the undercarriages being spaced apart in said direction and the second machine frame having a front end and a rear end with respect to said direction, (g) a coupling linking the second machine frame front end to the rear end of the first machine frame, (h) a plow arrangement vertically adjustably mounted on the second machine frame between the undercarriages thereof, the plow arrangement comprising (1) drive means connecting the plow arrangement to the second machine frame for vertically adjusting the plow arrangement with respect thereto, (2) a center plow for plowing ballast between the rails of the track, (3) shoulder plows for plowing ballast laterally adjacent each one of the rails, and (4) drive means for operating each one of the plows, (i) a third machine frame supported on two undercarriages, the undercarriages being spaced apart in said direction and the third machine frame having a front end and a rear end with respect to said direction, (j) a coupling linking the third machine frame front end to the rear end of the second machine frame, and (k) a track stabilization unit vertically adjustably mounted on the third machine frame between the undercarriages thereof, the track stabilization unit comprising (1) drive means connecting the track stabilization unit to the third machine frame for vertically adjusting the track stabilization unit with respect thereto, (2) track stabilizing tools engaging the rails, and (3) vibratory drive means connected to the track stabilizing tools for vibrating the same, (l) the front end of the second machine frame being supported on a rear one of the undercarriages supporting the first machine frame at the rear end thereof and the rear end of the second machine frame being supported on a front one of the undercarriages supporting the third machine frame at the front end thereof, said rear undercarriage of the first machine frame and a front undercarriage of the third machine frame at the front end thereof constituting the two undercarriages supporting the second machine frame.

2. The machine of claim 1, wherein the third machine frame rear end projects beyond the rear undercarriage of the third machine frame, and further comprising a ballast broom arrangement mounted on said projecting rear end.

3. The machine of claim 2, further comprising a driven, transversely extending conveyor band means arranged on said projecting rear end for receiving ballast from the broom arrangement and conveying the same laterally adjacent the rails.

4. The machine of claim 1, further comprising a respective operator's cab mounted at the front end of the first machine frame and at the rear end of the third machine frame, and a drive connected to at least one of the four undercarriages of the machine.

5. The machine of claim 4, wherein the undercarriages are two-axled swivel trucks.

6. The machine of claim 1, wherein the undercarriages supporting the first machine frame and the undercarriages supporting the third machine frame are sufficiently spaced in said direction for respectively permitting an effective leveling and lining of the track and an effective track stabilization between the spaced undercarriages, and further comprising respective track leveling and lining reference systems associated with the track lifting and lining unit and with the track stabilization unit.

7. A machine continuously advancing in an operating direction for maintaining or rehabilitating a railroad track consisting of two rails fastened to successive ties resting on ballast, which comprises:

(a) a first machine frame supported on two undercarriages for continuous movement in the operating direction, the undercarriages being spaced apart in said direction and the machine frame having a front end and a rear end with respect to said direction, (b) a carrier frame arranged between the undercarriages, (c) a track lifting and lining unit vertically adjustably mounted on the carrier frame, (d) a ballast tamping unit vertically adjustably mounted on the carrier frame, the ballast tamping unit comprising (a) pairs of reciprocatory and vibratory tamping tools immersible in the ballast upon vertical adjustment of the ballast tamping unit for tamping ballast under respective ones of said ties, (e) a drive linking the carrier frame to the first machine frame for longitudinally displacing the carrier frame with respect thereto, (f) a second machine frame supported on two undercarriages, the undercarriages being spaced apart in said direction and the second machine frame having a front end and a rear end with respect to said direction, (1) the front end of the second machine frame being supported on a rear one of the undercarriages supporting the first machine frame at the rear end thereof, said rear undercarriage of the first machine frame and a rear undercarriage of the second machine frame at the rear end thereof constituting the two undercarriages supporting the second machine frame, the second machine frame rear end projecting beyond the rear undercarriage of the second machine frame, (g) a ballast broom arrangement mounted on the projecting rear end of the second machine frame, (h) a coupling linking the second machine frame front end to the rear end of the first machine frame, and (i) a plow arrangement vertically adjustably mounted on the second machine frame between the undercarriages thereof, the plow arrangement comprising (1) drive means connecting the plow arrangement to the second machine frame for vertically adjusting the plow arrangement with respect thereto, (2) a center plow for plowing ballast between the rails of the track, (3) shoulder plows for plowing ballast laterally adjacent each one of the rails, and (4) drive means for operating each one of the plows.

8. The machine of claim 7, further comprising a driven, transversely extending conveyor band means arranged on said projecting rear end for receiving ballast from the broom arrangement and conveying the same laterally adjacent the rails.

9. The machine of claim 7, further comprising a respective operator's cab mounted at the front end of the first machine frame and at the rear end of the second machine frame, and a drive connected to at least one of the three undercarriages of the machine.

10. The machine of claim 9, wherein the undercarriages are two-axled swivel trucks.

* * * * *